US006550760B1

(12) United States Patent
Fisher, Sr.

(10) Patent No.: US 6,550,760 B1
(45) Date of Patent: Apr. 22, 2003

(54) SPRING NAIL FOR A SHEET FEEDING DEVICE

(75) Inventor: Terrence L. Fisher, Sr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 20 days.

(21) Appl. No.: 09/691,598

(22) Filed: Oct. 18, 2000

(51) Int. Cl.[7] ..... B65H 3/30; B65H 3/52; B65H 3/56

(52) U.S. Cl. ..... 271/19; 221/21; 221/22; 221/121; 221/169

(58) Field of Search ..... 271/19, 121, 169, 271/21, 22, 16, 104, 137, 167; 221/33; 400/578, 624, 629; 347/216; 358/498

(56) References Cited

U.S. PATENT DOCUMENTS

| | | | | |
|---|---|---|---|---|
| 3,919,972 A | | 11/1975 | Komori et al. | |
| 4,343,461 A | | 8/1982 | Tomimori et al. | |
| 5,002,266 A | | 3/1991 | Kikuchi et al. | |
| 5,096,182 A | | 3/1992 | Kashimura | |
| 5,135,321 A | * | 8/1992 | Olsen et al. | 400/283 |
| 5,193,797 A | | 3/1993 | Harada et al. | |
| 5,238,235 A | | 8/1993 | Nitta et al. | |
| 5,348,283 A | | 9/1994 | Yanagi et al. | |
| 5,364,195 A | | 11/1994 | Kanemitsu et al. | |
| 5,433,427 A | | 7/1995 | Ishikawa et al. | |
| RE35,341 E | | 10/1996 | Kikuchi et al. | |
| 5,648,807 A | | 7/1997 | Saito et al. | |
| 5,669,601 A | * | 9/1997 | Fisher | 271/117 |
| 5,697,716 A | | 12/1997 | Akahane | |
| 5,886,729 A | | 3/1999 | Hiramatsu et al. | |
| 5,946,016 A | | 8/1999 | Saito et al. | |

FOREIGN PATENT DOCUMENTS

JP 64-27978 * 1/1998 ..... B41J/13/10

OTHER PUBLICATIONS

Author: Mr. Gary Murphy, "Paper Feeders: The Good The Bad And The Ugly", Feb. 2000, Today; Boston, Feb. 2000 Edition (Copyright Association for Work Process Improvement, Feb. 2000), pp. 1 and 2.*

* cited by examiner

*Primary Examiner*—Donald P. Walsh
*Assistant Examiner*—Kenneth W Bower
(74) *Attorney, Agent, or Firm*—Norman Rushefsky

(57) ABSTRACT

Spring nail (32, 34, 72, 96) for a sheet feeding device (10). The spring nail (32, 34, 72, 96) has a mounting end (36, 74) for attaching to the sheet feeding device (10) and a free end (38, 78) opposite the mounting end (36, 74), the free end (38, 78) being disposed to engage a top sheet (16) of a stack of sheets (14) to be fed and exert a resilient biasing force thereagainst to form a loop or bow in the top sheet (16) for separating the top sheet (16) from the stack (14) when the top sheet (16) is to be removed from the stack (14). The spring nails (32, 34, 72, 96) are preferably positioned for engaging the respective leading corners (28, 30) of the top sheet (16) and each has a spring arm portion (40, 80) between the mounting end (36, 74) and the free end (38, 78) having properties of a spring for resiliently biasing the free end (38, 78) against the top sheet (16).

24 Claims, 5 Drawing Sheets

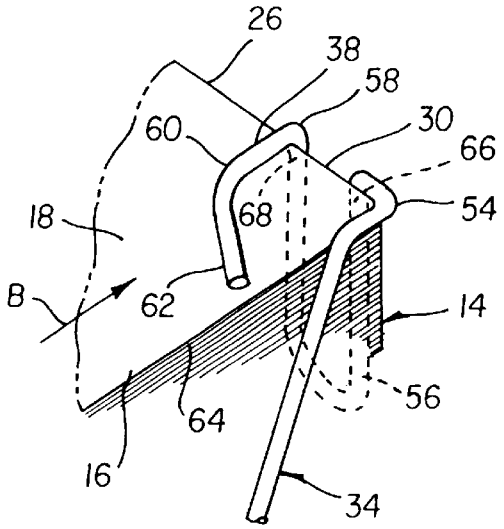
FIG. 3A
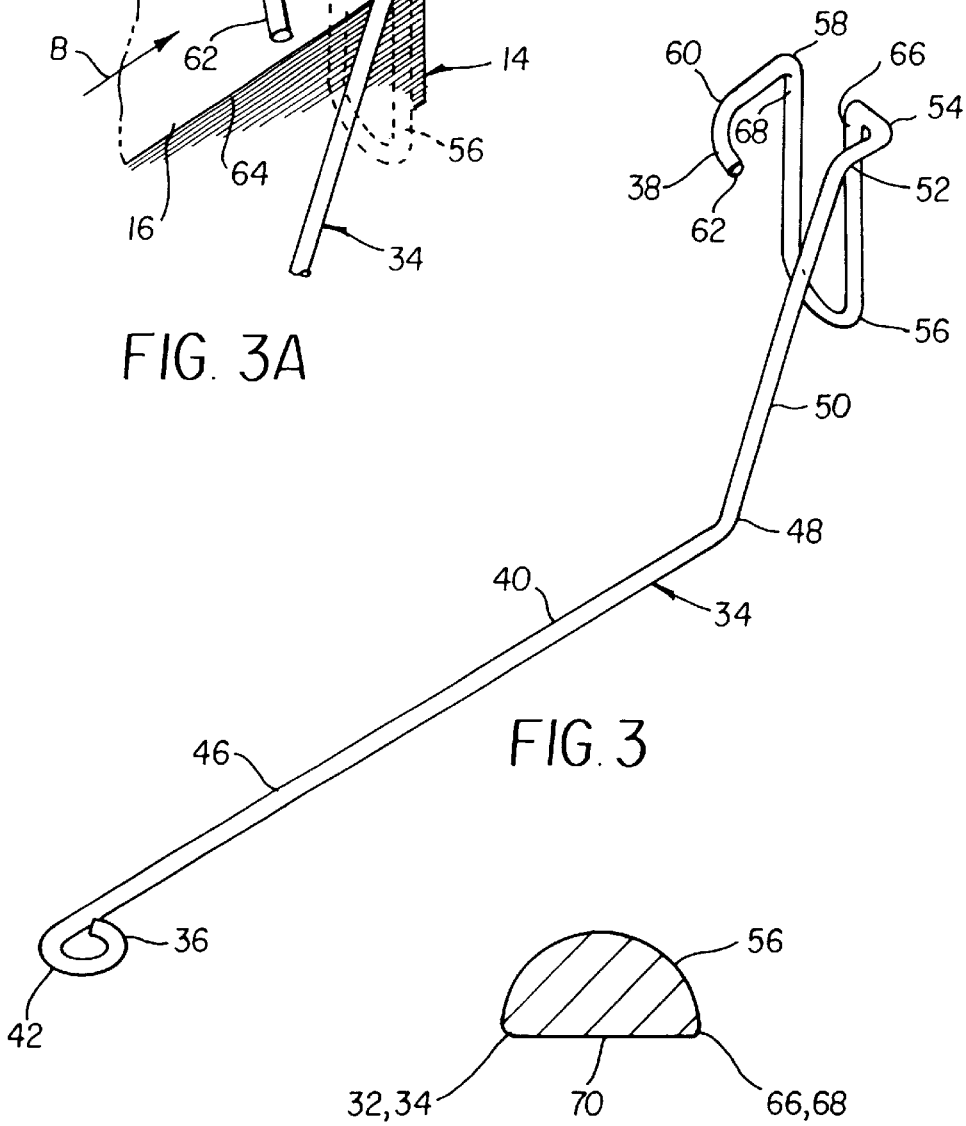
FIG. 3
FIG. 4

SPRING NAIL FOR A SHEET FEEDING DEVICE

FIELD OF THE INVENTION

This invention relates generally to sheet feeding devices, and more particularly, to devices commonly known as "nails" used for forcing a loop or bow in a top sheet of a stack to separate the top sheet from the stack to avoid double feeding.

BACKGROUND OF THE INVENTION

Many known printers utilize a stack of image receiving or printing medium sheets such as paper or transparencies in a storage tray, cassette, or the like, which sheets are picked or fed one at a time from the top of the stack to a print station. Commonly, a roller or other picker device is utilized to engage the top surface of the top sheet of the stack to push the top sheet off of the stack while the devices such as pawls or the devices occasionally known as nails or "corner nails," for their location adjacent to the leading edge corners of the top sheet, function to resist movement of the top sheet. In concert with resisting movement of the top sheet, the nails force a loop or bow in the top sheet which operates to separate it from the next succeeding sheet on the stack to prevent a double feed, that is, the feeding of both the top sheet and the next succeeding sheet or sheets. Reference for example, my U.S. Pat. No. 5,669,601, issued Sep. 23, 1997 to Eastman Kodak Company, Rochester, N.Y., which shows a representative corner nail construction. Typically, known corner nails such as that disclosed in my patent utilize gravity or a separate mechanical spring to keep the nail in contact with the corner of the top sheet. However, for some applications, gravity may be an inadequate force, or may require too large of a nail. In the alternative, use of a separate spring to bias the nail against the corner of the top sheet may be disadvantageous costwise. It has also been found desirable to minimalize friction, the occurrence of burrs on the nails, and other impediments to smooth movement between the nail and the top sheet during removal of the top sheet from the stack.

Therefore, there is a need to provide a sheet feeding device including a new corner nail construction which provides effective yet low frictional contact with a top sheet of a stack for preventing or limiting the occurrence of double feeding, is advantageous costwise, and does not rely on gravity or require a separate spring for operation.

SUMMARY OF THE INVENTION

An object of the present invention is to provide a sheet feeding device including a new nail construction which is advantageous costwise, provides effective yet low frictional contact with a top sheet of a stack for preventing or limiting the occurrence of double feeding, and which does not rely on gravity or a separate spring for operation.

With this object in view, the present invention resides in a spring nail for a sheet feeding device having one end for attaching to the sheet feeding device and a free end opposite the mounting end, the free end being disposed to engage a top sheet of a stack of sheets to be fed and exert a resilient biasing force thereagainst to form a loop or bow in the top sheet for separating the top sheet from the stack when the top sheet is removed from the stack.

The present invention also resides in a sheet feeding device including an element for supporting a stack of sheets including a top sheet to be fed, the top sheet having a top surface, and at least one spring nail having a mounting end attached to the sheet feeding device and a free end opposite the mounting end, the free end being disposed to engage and exert a resilient biasing force against the top surface of the top sheet to force a loop or bow in the top sheet for separating the top sheet from the stack when the top sheet is removed from the stack.

According to an exemplary embodiment of the present invention, one each of the spring nails is provided for engaging each leading edge corner of the top sheet.

According to another exemplary embodiment of the invention, the spring nail has an integral spring arm portion between the mounting end and the free end having properties of a spring for resiliently biasing the free end of the nail against the top sheet.

According to another exemplary embodiment of the present invention, the spring nail can comprise a wire material such as a spring wire, a metal music wire, or the like. According to another exemplary embodiment of the invention, the wire spring nail has a generally round cross-sectional shape.

According to another exemplary embodiment of the present invention, the spring nail can comprise a molded plastics material.

According to another exemplary embodiment of the present invention, the spring nail can comprise a sheet metal material.

According to still another exemplary embodiment of the invention, the free end of the spring nail has a flat surface portion positioned for engaging a leading edge of the top sheet.

A feature of the present invention is the provision of a nail having an inherent spring property for resiliently biasing it into contact with a top sheet of a stack to be fed.

Another feature of the present invention is the provision of a wire spring nail having a rounded surface for engaging a top surface of a top sheet of a stack to be fed such that less friction is present between the top sheet and the nail.

Another feature of the present invention is the provision of an effective spring nail for a sheet feeding device which eliminates the need for gravity or a separate, external spring for urging the nail into contact with a top sheet of a stack to be fed.

These and other objects, feature and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompany drawings wherein:

FIG. 3 is perspective view of one of the nails of FIG. 1;

FIG. 3A is a fragmentary perspective view of the nail of FIG. 1 showing the relationship thereof to a top sheet and leading edge of a stack of sheets to be fed;

FIG. 4 is a cross-sectional view of an alternative wire spring nail including a flat surface portion for engaging an edge of the top sheet to be fed according to the present invention;

DETAILED DESCRIPTION OF THE INVENTION

The present description will be directed in particular to elements forming part of, or cooperating more directly with, apparatus in accordance with the present invention. It is to be understood that elements not specifically shown or described may take various forms while known to those skilled in the art.

Figure 1:
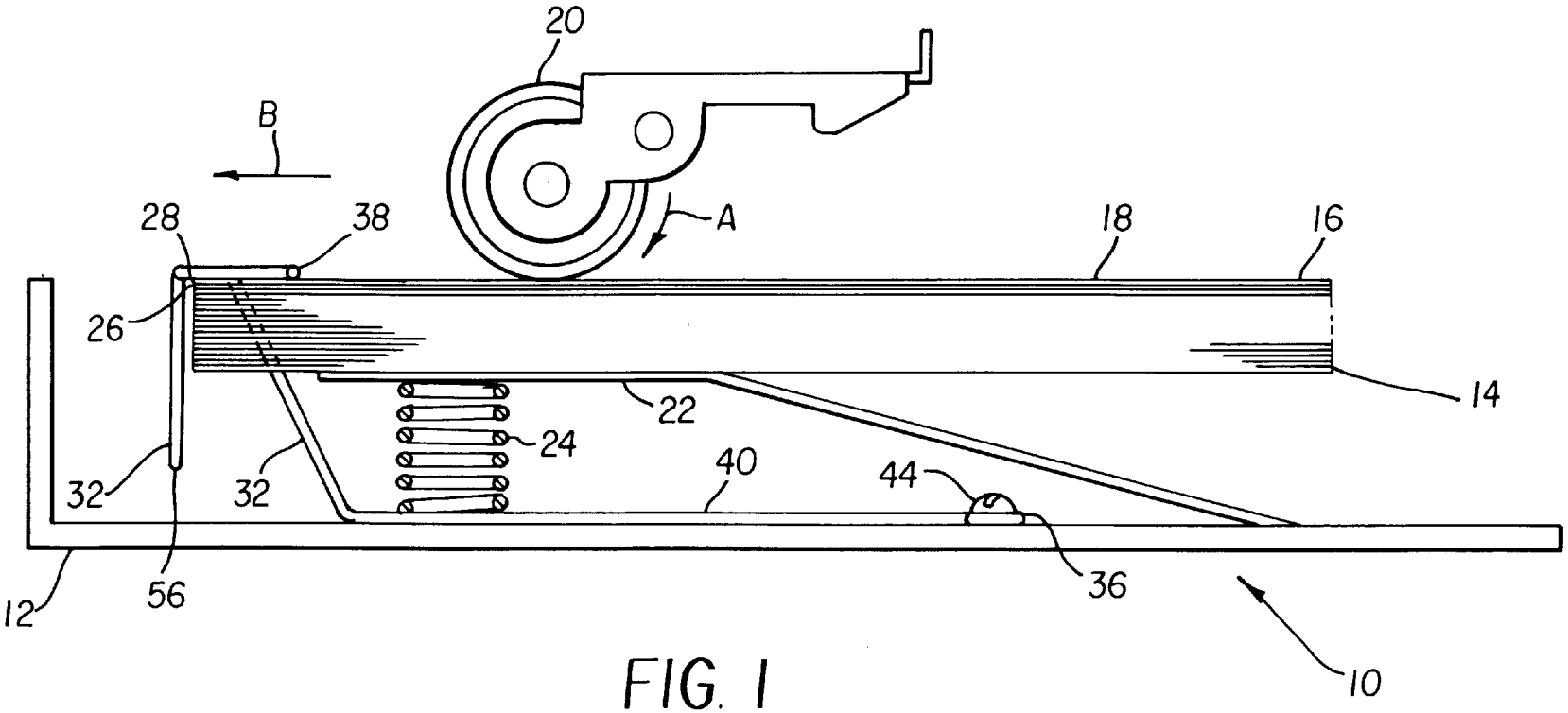
FIG. 1 is a simplified schematic side view of a sheet feeding device including spring nails belonging to the present invention.
Figure 2:
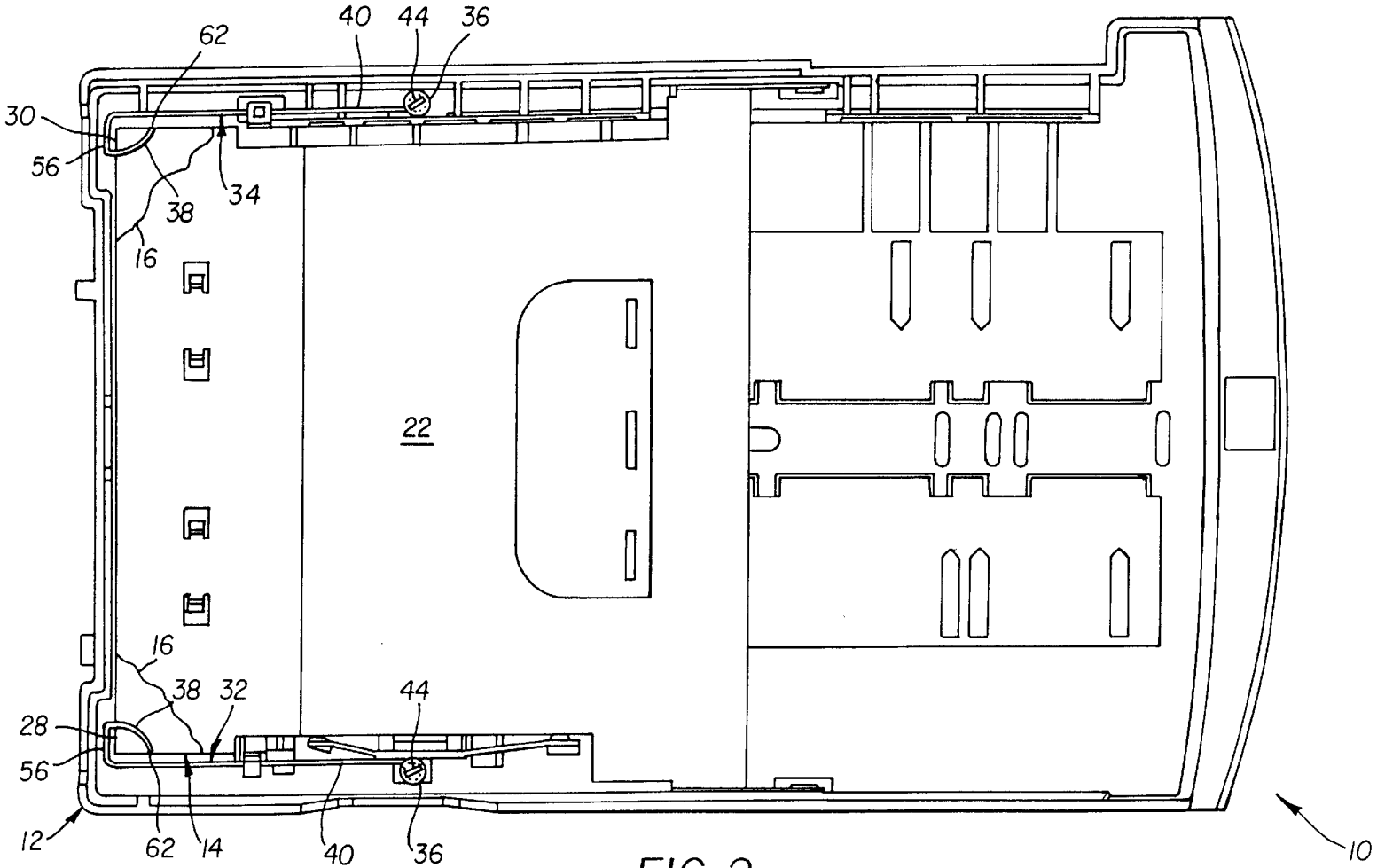
FIG. 2 is a reduced top view of the sheet feeding device of FIG. 1 showing the nails.

Therefore, referring to FIGS. 1 and 2, there is shown pertinent portions of a sheet feeding device 10, for instance, for feeding sheets individually or one by one to a print station (not shown) such as but not limited to any of those well known printer constructions currently commercially available. Device 10 includes a sheet storage tray 12 for holding and positioning a stack of sheets 14 including a top sheet 16 having a top surface 18. The sheets of stack 14 are to be fed to the print station (not shown) individually or one by one for printing imagewise on one or both opposite surfaces thereof in the well known conventional manner. Such feeding is effected by at least one scuff roller or other suitable picking device 20 which is rotated by a motor or other means (not shown) in a clockwise direction, as denoted by arrow A, to frictionally engage top surface 18 of top sheet 16 to drive top sheet 16 to the left, as denoted by the arrow B. Stack 14 is supported on a sheet supply platen 22, and is urged in a direction toward picking device 20 to engage top surface 18 of top sheet 16 with picking device 20, by a coil spring 24 disposed between a bottom surface of platen 22 and a top surface of tray 12. Top sheet 16 has a leading edge 26 and opposed leading corners 28, 30 in reference to the feed direction denoted by the arrow B.

The device 10 includes spring nails 32, 34 positioned for engaging leading corners 28, 30, respectively of top sheet 16 as it is being driven in the direction denoted by the arrow B to effect separation of sheet 16 from the next succeeding sheet of the stack such that only sheet 16 is fed to the print station, as will be explained.

Referring also to FIG. 3, wherein spring nail 34 is shown for clarity, each spring nail 32, 34 is preferably made of a material providing a desired inherent resilient, spring or spring-like property such as, but not limited to, commercially available steel spring wire such as an S1020 or an S2000 series music wire, or the like. Each spring nail 32, 34 has a mounting end 36, a free end 38 opposite mounting end 36, and an integral spring arm portion 40 extending between mounting end 36 and free end 38. Mounting end 36 is formed into a loop 42 for receiving a fastener such as a screw 44 or the like for attaching the nail to tray 12. Spring arm portion 40 has an elongate, generally straight portion 46 which extends from mounting end 36 to an upward bend 48. Spring arm portion 40 includes a second straight portion 50 extending from bend 48 to a bend 52 where spring arm portion 40 connects to free end 38. All of spring arm portion 40 is adapted to be located beside stack 14 as shown when the nail 32, 34 is attached to the tray 12.

Referring also to FIG. 3A which illustrates free end 38 of spring nail 34 engaged with leading corner 30 of top sheet 16, the free ends 38 each include a bend 54 which positions free end 38 adjacent the leading end of stack 14 with respect to the direction denoted by the arrow B, and a U-shape portion 56 which extends downwardly from bend 54 beside or abutting leading edges 26 of the sheets of stack 14. U-shape portion 56 connects at a bend 58 to a J-shape nail portion 60 which extends to a terminal end 62 located atop top sheet 16 at a location generally close to a side edge 64 thereof, such that J-shape nail portion 60 effectively spans the respective leading corner 28 or 30 of top surface 18 of top sheet 16.

In operation, when top sheet 16 is urged in the direction denoted by the arrow B by picking device 20, leading edge 26 of the top sheet is brought into engagement with top portions 66 and 68 of the U-shape portions 56 of each of the spring nails 32, 34. With continued movement in the direction denoted by the arrow B, top sheet 16 is forced into an upwardly extending bow or loop by contact with J-shape nail portions 60 of spring nails 32, 34, so as to be effectively separated from the next succeeding sheet of the stack, such that only top sheet 16 is fed to the print station and a double feed is avoided. When the top sheet 16 has been fed, the stack 14 is urged upwardly by the constant force of spring 24 such that the next successive sheet is brought into contact with J-shape nail portions 60 of spring nails 32, 34 to become the new top sheet ready for feeding in the same manner. Because at least spring arm portions 40 of spring nails 32, 34 possess an inherent spring or resilient property, the spring nails 32, 34 function to exert a substantially constant biasing force in opposition to the force of spring 24 so as to maintain contact with and desirably position the top sheet 16 for feeding. The biasing force also facilitates the smooth movement and formation of top sheet 16 into a bow or loop, as do the free ends 38 of the nails 32, 34 which are of round or rounded cross sectional shape so as to minimize friction in contact with top sheet 16 and the occurrence of burrs.

Spring nails 32, 34 have a free state shape and are positioned as best shown by spring nail 32 in FIG. 1 and by both nails in FIG. 2, and desirably possess enough memory by virtue of their resiliency or spring property so as to at least substantially maintain this shape and position both when just opposing the force of spring 24 and during the sheet feeding operation. Here, is should be noted that to exert the desired resilient biasing force, just straight portions 46 of the spring arm portions 40 of spring nails 32, 34 can possess the inherent resilient or spring property, although for ease of manufacture, a larger portion or even the entire spring nail may possess the resilient spring property.

Referring to FIG. 4, as an additional feature, top portions 66, 68 of U-shape portion 56 of spring nails 32, 34 can optionally include a generally flat surface portion 70 positioned for engagement with leading edge 26 of at least top sheet 16 to limit or substantially prevent the occurrence of denting of the top sheet when urged thereagainst or brought into contact therewith.

Figure 5:
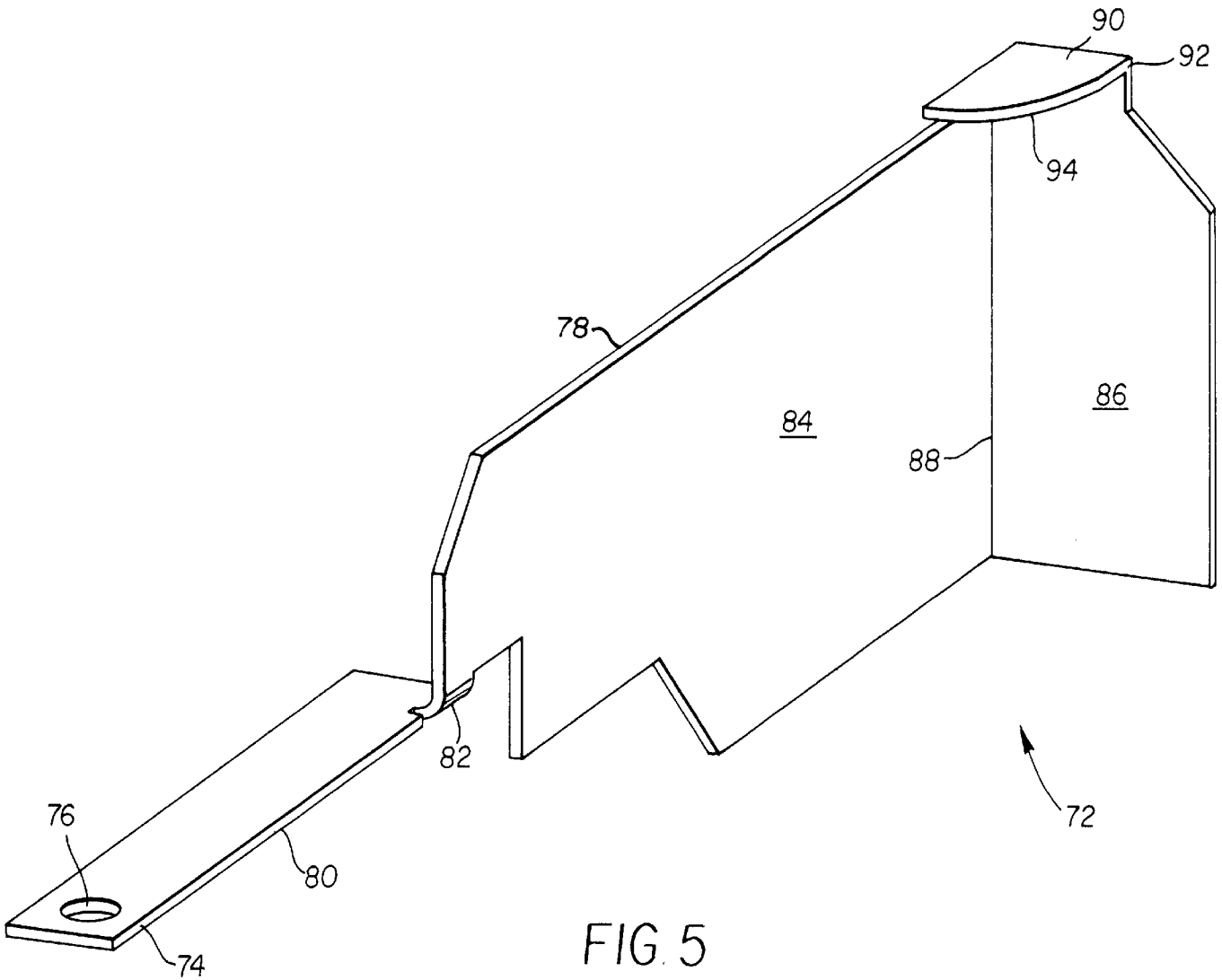
FIG. 5 is a perspective view of a second spring nail construction belonging to the present invention.

Turning to FIG. 5, a second spring nail 72 according to the present invention is shown. Spring nail 72 and a companion spring nail 96 (FIG. 6) which is a mirror image of spring nail 72, are attachable to tray 12 in a similar manner to spring nails 32, 34, and include the desired inherent resilient spring property so as to be operable in the above explained manner with reference to spring nails 32, 34 for forcing a bow or loop in a top sheet of a stack of sheets such as top sheet 16 of stack 14 for separating the top sheet from the stack for feeding. Spring nails 72, 96 are each preferably composed of a steel or plastics material, such as, but not limited to, a high modulus stainless steel sheet material or an injection molded plastics material. Spring nails 72, 96 each include a mounting end 74 having a hole 76 therethrough for receiving a fastener such as screw 44 for attachment to tray 12, a free end 78 opposite mounting end 74, and an integral spring arm portion 80 extending between mounting end 74 and free end 78. Spring arm portion 80 has a generally straight, elongate, flat shape and is oriented so as to be generally parallel to the sheets of stack 14. Additionally, at least spring arm portion 80 possesses a resilient spring property which allows spring nails 72, 96 to exert the biasing force against the top sheet of the stack as discussed above. Free end 78 is connected to spring arm portion 80 by a bend 82 and includes a relatively large, generally planar side portion 84 oriented and positioned so as to be located beside or in abutment with a side of the stack 14 when spring nail 72, 96 is mounted on tray 12, and a planar end portion 86 connected to side portion 84 at a corner 88 and oriented generally perpendicularly to side portion 84 so as to be located beside or in abutment with the leading end of stack 14. Free end 78 of each spring nail 72, 96 additionally includes a nail portion 90 connected to end portion 86 along a top portion 92 thereof and extending toward mounting end 74 along or adjacent to a top portion of side portion 84. Nail portion 90 of each spring nail 72, 96 has a generally arcuate shape edge portion 94 which spans a corner area defined or bordered by side portion 84 and end portion 86 adjacent to corner 88 so as to be effectively located over a leading corner 28 or 30 of top sheet 16 of stack 14, like J-shape nail portion 60 of nails 32, 34.

Figure 6:
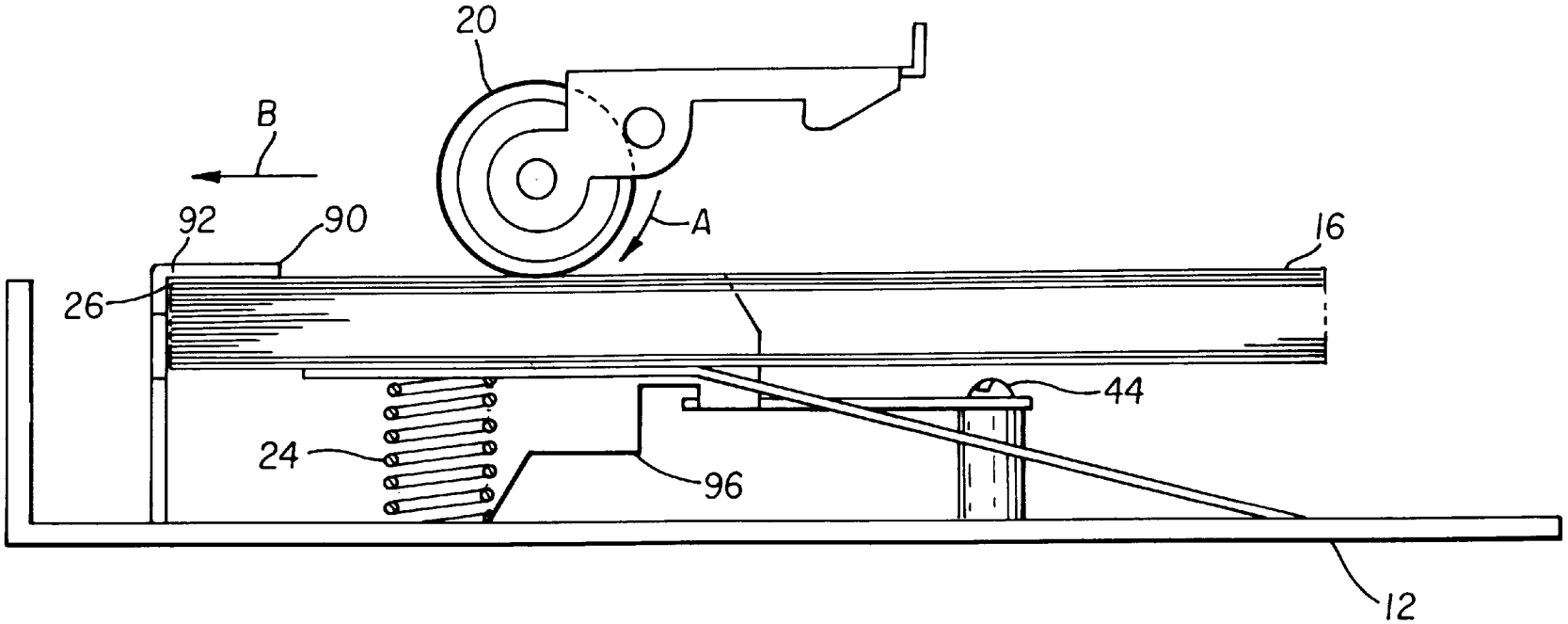
FIG. 6 is another simplified schematic side view of the sheet feeding device of FIG. 1 illustrating use of the second spring nail construction.

Referring to FIG. 6, spring nail 96 is shown mounted to tray 12 in a similar manner to spring nails 32, 34 by a screw 44 to illustrate the operation of spring nails 72, 96. In operation, when top sheet 16 is urged in the direction denoted by the arrow B by rotation of picking device 20 in the direction denoted by the arrow A, leading edge 26 of the top sheet is brought into engagement with the top portion 92 of each of the spring nails 72, 96. With continued movement in the direction denoted by the arrow B, top sheet 16 is forced into an upwardly extending bow or loop by contact with the nail portion 90 of each of the spring nails 72, 96, so as to be effectively separated from the next succeeding sheet of the stack, such that only top sheet 16 is fed to the print station and a double feed is avoided. When the top sheet 16 has been fed, the stack 14 is urged upwardly by the constant force of spring 24 such that the next successive sheet is brought into contact with the nail portion 90 of each of the spring nails 72, 96 to become the new top sheet ready for feeding in the same manner. Because at least spring arm portion 80 of each of spring nails 72, 96 possess a spring or resilient property, the spring nails function to exert a substantially constant biasing force in opposition to the force of spring 24 so as to maintain contact with and desirably position the top sheet 16 for feeding. The biasing force also facilitates the smooth movement and formation of top sheet 16 into a bow or loop, and edge portion 94 of the nail portion 90 can have a smooth, rounded shape so as to minimize frictional contact with top sheet 16.

Spring nails 72, 96 each have a free state shape as shown in FIGS. 5 and 6 and desirably possess enough memory by virtue of the resiliency or spring property of spring arm portion 80 thereof so as to at least substantially maintain this shape and position both when just opposing the force of spring 24 and during the sheet feeding operation. Here, is should be noted that to be capable of providing the desired resilient biasing force, just the spring arm portion 90 of the spring nails 72, 96 can possess the resilient or spring property, although for ease of manufacture, a larger portion or even the entire spring nails 72, 96 may possess the resilient spring property.

Here, it should be understood that all or a portion of the spring nails of the present invention can have a wide variety of different shapes, sizes and configurations for providing the desired operational and other advantages and features. For instance, the spring arm portions of the spring nails can be longer or shorter than those shown for providing greater or lesser degrees of flexibility, respectively. Different numbers of the nails can be used, and the nails can be used in cooperation with other devices for effecting separation of the top sheet. For instance, one of the present nails could be used in association with one leading corner of a top sheet in the above-described manner and a blocking device used in association with the other leading corner so as to cooperate to effect the separation of the top sheet. A single nail could be used for engaging the center of the leading edge of the top sheet. The free end of the spring nails can also have shapes, sizes and configurations which differ from the exemplary embodiments disclosed herein for effecting the desired bow or loop in the top sheet, without departing from the scope of the invention. For instance, the free end could be wider or narrower or have a different shape so as to be more effective for use with various sheet constructions such as transparencies and the like.

Additionally, the integral and inherent resilient spring property of the nails of the present invention can be provided in ways additional to those disclosed above, for instance, a torsional spring arm or element could be used, and the mounting end can be adapted for mounting in a wide variety of different ways to a side wall or other portion or element of a sheet feeding device such that a twisting displacement or loading of the torsional spring arm is effected for providing the force exerted against the top sheet, without departing from the scope of the invention.

Therefore, several embodiments of a spring nail have been provided for forcing a top sheet of a stack of sheets into an upwardly extending bow or loop so as to effectively separate the top sheet from the next succeeding sheet of the stack for feeding only the top sheet 16 to a print station or the like, which eliminates the shortcomings and limitations associated with using gravity or a separate spring.

PARTS LIST

10=sheet feeding device
12=sheet storage tray
14=stack of sheets
16=top sheet
18=top surface
20=picking device
22=sheet supply platen
24=spring
26=leading edge
28=leading corner
30=leading corner
32=spring nail
34=spring nail
36=mounting end
38=free end
40=spring arm portion
42=loop
44=screw
46=straight portion
48=upward bend
50=second straight portion
52=bend

54=bend
56=U-shape portion
58=bend
60=nail portion
62=terminal end
64=side edge
66=top portion
68=top portion
70=surface portion
72=spring nail
74=mounting end
76=hole
78=free end
80=spring arm
82=bend
84=side portion
86=end portion
88=corner
90=nail portion
92=top portion
94=edge portion
96=spring nail

What is claimed is:

1. A spring nail for a sheet feeding device, comprising:

a mounting end for attaching to the sheet feeding device and a free end opposite the mounting end, the free end being disposed to engage and exert a resilient biasing force against a top sheet of a stack of sheets to be fed to force a loop or bow in the top sheet for separating the top sheet from the stack when the top is sheet removed from the stack wherein at least the free end has a generally rounded cross-sectional shape.

2. The spring nail of claim 1 further comprising a spring arm portion having a resilient spring property disposed between said mounting end and said free end.

3. The spring nail of claim 2 wherein the free end is disposed to engage a corner of a top surface of the top sheet.

4. The spring nail of claim 1 wherein when the free end has a generally flat surface portion disposed for engaging an edge of the top sheet.

5. The spring nail of claim 1 wherein the spring nail is made from a material selected from the group consisting of music wire and spring wire.

6. The sheet spring nail of claim 1 wherein the spring nail includes an integral spring arm portion between the mounting end and the free end, and the mounting end being formed into a loop for receiving a fastener to attach the spring nail to a tray for supporting the stack of sheets, the spring arm portion further including an elongate generally straight portion which extends from the mounting end to an upward bend portion and a second straight portion that extends from the upward bend portion to a second bend portion which connects the spring arm portion to the free end.

7. A spring nail for a sheet feeding device, comprising:

a mounting end for attaching to the sheet feeding device and a free end opposite the mounting end, the free end being disposed to engage and exert a resilient biasing force against a top sheet of a stack of sheets to be fed to force a loop or bow in the top sheet for separating the top sheet from the stack when the top is sheet removed from the stack wherein the spring nail is molded of a plastics material.

8. A sheet feeding device comprising:

an element for supporting a stack of sheets including a top sheet to be fed, the top sheet having a top surface; and at least one spring nail having a mounting end attached to the sheet feeding device and a free end opposite the mounting end, the free end being disposed to engage and exert a resilient biasing force against the top surface of the top sheet to force a loop or bow in the top sheet for separating the top sheet from the stack when the top sheet is removed from the stack wherein the spring nail is made from a wire selected from the group consisting of spring wire and music wire.

9. A sheet feeding device comprising:

an element for supporting a stack of sheets including a top sheet to be fed, the top sheet having a top surface; and at least one spring nail having a mounting end attached to the sheet feeding device and a free end opposite the mounting end, the free end being disposed to engage and exert a resilient biasing force against the top surface of the top sheet to force a loop or bow in the top sheet for separating the top sheet from the stack when the top sheet is removed from the stack wherein the spring nail has a generally round cross-sectional shape.

10. The sheet feeding device of claim 9 wherein the sheets are to be fed in a first direction, and the free end of the spring nail is disposed to engage and exert the biasing force against a corner of a leading edge of the top sheet with respect to the first direction.

11. The sheet feeding device of claim 10 wherein the spring nail has a generally flat portion positioned for engaging the leading edge of the top sheet.

12. The sheet feeding device of claim 9 comprising two of the spring nails.

13. The sheet feeding device of claim 9 wherein the at least one spring nail is attached to a tray for holding the stack of sheets.

14. The sheet feeding device of claim 8 wherein the spring nail has an elongate spring arm portion between the mounting end and the free end, and at least the spring arm portion has a resilient property.

15. The sheet feeding device of claim 9 wherein the spring nail has an elongate spring arm portion between the mounting end and the free end, and at least the spring arm portion has a resilient property.

16. The sheet feeding device of claim 15 wherein the spring arm portion comprises a spring wire.

17. The sheet feeding device of claim 15 wherein the spring arm portion comprises spring metal.

18. A spring nail for a sheet feeding device, comprising:

a mounting end for attaching to the sheet feeding device and a free end opposite the mounting end, the free end being disposed to engage a top sheet of a stack of sheets to be fed, and a spring arm portion disposed between the mounting end and the free end to urge the free end against the top sheet to force a loop or bow in the top sheet for separating the top sheet from the stack when the top is sheet removed from the stack wherein the spring nail is made from a material selected from the group consisting of music wire and spring wire.

19. A spring nail for a sheet feeding device, comprising:

a mounting end for attaching to the sheet feeding device and a free end opposite the mounting end, the free end being disposed to engage a top sheet of a stack of sheets to be fed, and a spring arm portion disposed between the mounting end and the free end to urge the free end against the top sheet to force a loop or bow in the top sheet for separating the top sheet from the stack when the top is sheet removed from the stack wherein the spring nail is molded of a plastics material.

20. A sheet feeding method comprising:

supporting a stack of sheets including a top sheet to be fed, the top sheet having a top surface; and providing a spring nail having one end mounted and a free end opposite the mounting end, the free end having a generally rounded cross-sectional shape, and disposing the free end to engage and exert a resilient biasing force against the top surface of the top sheet to force a loop or bow in the top sheet for separating the top sheet from the stack when the top sheet is removed from the stack.

21. The sheet feeding method of claim 20 wherein the spring nail includes an integral spring arm portion between the mounting end and the free end, and the mounting end being formed into a loop that receives a fastener to attach the spring nail to a tray that supports the stack of sheets, the spring arm portion further including an elongate generally straight portion which extends from the mounting end to an upward bend portion and a second straight portion that extends from the upward bend portion to a second bend portion which connects the spring arm portion to the free end.

22. The sheet feeding method of claim 20 wherein the sheets are fed in a first direction, and the free end of the spring nail engages and exerts the biasing force against a corner of a leading edge of the top sheet with respect to the first direction.

23. The sheet feeding method of claim 22 wherein the free end has a generally flat surface portion disposed for engaging an edge of the top sheet.

24. The sheet feeding method of claim 22 wherein the spring nail is made from a material selected from the group consisting of music wire and spring wire.

* * * * *